US012768233B2

(12) United States Patent
Halim et al.

(10) Patent No.: US 12,768,233 B2
(45) Date of Patent: Oct. 20, 2026

(54) MULTI-MODE AUTOMATION METHOD FOR WELL INTERVENTION APPLICATIONS

(71) Applicant: Halliburton Energy Services, Inc., Houston, TX (US)

(72) Inventors: Andriyanto Halim, Singapore (SG); Dalmo Wakabayashi, Houston, TX (US); Winston Alfred Rodrigues, Singapore (SG); David Yan Lap Wong, Houston, TX (US); Yong Sern Gwee, Singapore (SG); Weiwei Hong, Singapore (SG); Alberto Quintero, Houston, TX (US); Gerard Steven Mackay, Houston, TX (US); Guo Sheng Jin, Singapore (SG); Chong Yong Koh, Singapore (SG); Carlos Eduardo Mogollon, Houston, TX (US); Sicris Rey Embay, Singapore (SG); Hock Soon Tiew, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 19/331,718

(22) Filed: Sep. 17, 2025

(65) Prior Publication Data

US 2026/0251027 A1 Aug. 27, 2026

Related U.S. Application Data

(60) Provisional application No. 63/763,430, filed on Feb. 26, 2025.

(51) Int. Cl.

| | |
|---|---|
| ***E21B 23/01*** | (2006.01) |
| ***E21B 34/14*** | (2006.01) |
| *E21B 31/00* | (2006.01) |

(52) U.S. Cl.

CPC ..... *E21B 23/01* (2013.01); *E21B 34/14* (2013.01); *E21B 31/00* (2013.01); *E21B 2200/04* (2020.05)

(58) Field of Classification Search

CPC ..... E21B 2200/04; E21B 23/01; E21B 47/04; E21B 47/09; E21B 34/14

See application file for complete search history.

(56) References Cited

U.S. PATENT DOCUMENTS 6,598,682 B2 * 7/2003 Johnson ..... E21B 21/00 166/163
10,544,657 B2 * 1/2020 MacDougall ..... E21B 23/01
(Continued)

OTHER PUBLICATIONS

International Search Report and Written Opinion for International Patent Application No. PCT/US2025/050228 dated Feb. 3, 2026. PDF file. 11 pages.

*Primary Examiner* — Kenneth L Thompson
(74) *Attorney, Agent, or Firm* — Benjamin Ford; C. Tumey Law Group PLLC

(57) ABSTRACT

A method may include configuring an intervention tool for an intervention operation, disposing the intervention tool into a wellbore, conveying the intervention tool a first location in the wellbore, and performing a seek operation to identify a location of sliding sleeve. The method may further include anchoring the intervention tool to the wellbore, latching the intervention tool to the sliding sleeve, and shifting the sliding sleeve with the intervention tool.

21 Claims, 6 Drawing Sheets

(56) References Cited

U.S. PATENT DOCUMENTS

| | | | | |
|---|---|---|---|---|
| 11,428,062 | B2 * | 8/2022 | Hansen | E21B 43/112 |
| 12,241,337 | B2 * | 3/2025 | Wai | E21B 23/01 |
| 2002/0066556 | A1 | 6/2002 | Goode et al. | |
| 2005/0046592 | A1 | 3/2005 | Cooper et al. | |
| 2005/0270171 | A1 | 12/2005 | Quintero et al. | |
| 2008/0083533 | A1 | 4/2008 | Malone et al. | |
| 2008/0201969 | A1 | 8/2008 | Davies et al. | |
| 2010/0073189 | A1 | 3/2010 | Mandal et al. | |
| 2013/0118762 | A1 | 5/2013 | Kellner | |
| 2015/0226055 | A1 | 8/2015 | Ringgenberg et al. | |
| 2015/0275654 | A1 | 10/2015 | Ringgenerg et al. | |
| 2016/0076361 | A1 | 3/2016 | Wong | |
| 2016/0116889 | A1 | 4/2016 | Zacharko et al. | |
| 2016/0139292 | A1 | 5/2016 | Lie et al. | |
| 2016/0208604 | A1 | 7/2016 | Cao et al. | |
| 2016/0274261 | A1 | 9/2016 | Cao et al. | |
| 2016/0277136 | A1 | 9/2016 | Jin et al. | |
| 2016/0290059 | A1 | 10/2016 | Hardin et al. | |
| 2016/0299247 | A1 | 10/2016 | Viassolo et al. | |
| 2016/0299253 | A1 | 10/2016 | Zhang et al. | |
| 2017/0023695 | A1 | 1/2017 | Zhang et al. | |
| 2017/0226848 | A1 | 8/2017 | Chatelet et al. | |
| 2018/0136355 | A1 | 5/2018 | Zhang et al. | |
| 2018/0139678 | A1 | 5/2018 | Shashoua et al. | |
| 2018/0340419 | A1 | 11/2018 | Wakabayashi et al. | |
| 2018/0371898 | A1 | 12/2018 | Murali et al. | |
| 2019/0052374 | A1 | 2/2019 | Lie et al. | |
| 2022/0213787 | A1 | 7/2022 | Schaecher et al. | |
| 2023/0161316 | A1 | 5/2023 | Laplane et al. | |
| 2023/0349250 | A1 | 11/2023 | Jin et al. | |
| 2024/0426177 | A1 | 12/2024 | Tiew et al. | |
| 2024/0426180 | A1 | 12/2024 | Koh | |
| 2024/0427311 | A1 | 12/2024 | Tiew et al. | |
| 2025/0034962 | A1 | 1/2025 | Powell et al. | |
| 2025/0283402 | A1 | 9/2025 | Dave et al. | |
| 2026/0002437 | A1 | 1/2026 | Jin et al. | |

* cited by examiner

MULTI-MODE AUTOMATION METHOD FOR WELL INTERVENTION APPLICATIONS

CROSS REFERENCE TO RELATED APPLICATIONS

This application claims the priority of U.S. Provisional Patent Application No. 63/763,430, filed Feb. 26, 2025, which is incorporated by reference in its entirety.

BACKGROUND

Disposed downhole within a wellbore may be any number of downhole tools. Some of these tools, such as sliding sleeves, may utilize intervention tool disposed on a conveyance to operate. These types of operations may be defined as well intervention operations.

Existing solutions for operating intervention tools require human operator input. This input may be sent from surface to control the intervention tool during intervention operations by "downlink commands". This type of communication may be heavily reliant on the human operator and therefore leave margin of errors from operational error to human error.

BRIEF DESCRIPTION OF THE DRAWINGS

These drawings illustrate certain aspects of some of the embodiments of the present disclosure and should not be used to limit or define the disclosure.

DETAILED DESCRIPTION

Disclosed herein are methods and systems for an intervention tool to perform well intervention operations. Well intervention applications may comprise such operations as opening and closing the ball valve by using the intervention tool. As discussed below, the intervention tool may comprise a sensor sub (SS), power and telemetry (P&T), anchor, actuator and shifter. These mechanical tools are stringed up and used inside the well to provide push or pull forces to open and close the ball valve.

By automating the intervention operations, it liberates the system from human error and operational error, allowing the intervention tool to have consistent behavior at each operation. Users only need to preconfigure the tool parameters on the surface, rig it up and send it downhole and let it perform the operation automatically with the control algorithms residing in one of the tools. In the event of unforeseen circumstances, the user may abort the operation, and the intervention tool may automatically release itself so that the user can bring it uphole for inspection.

Figure 1:
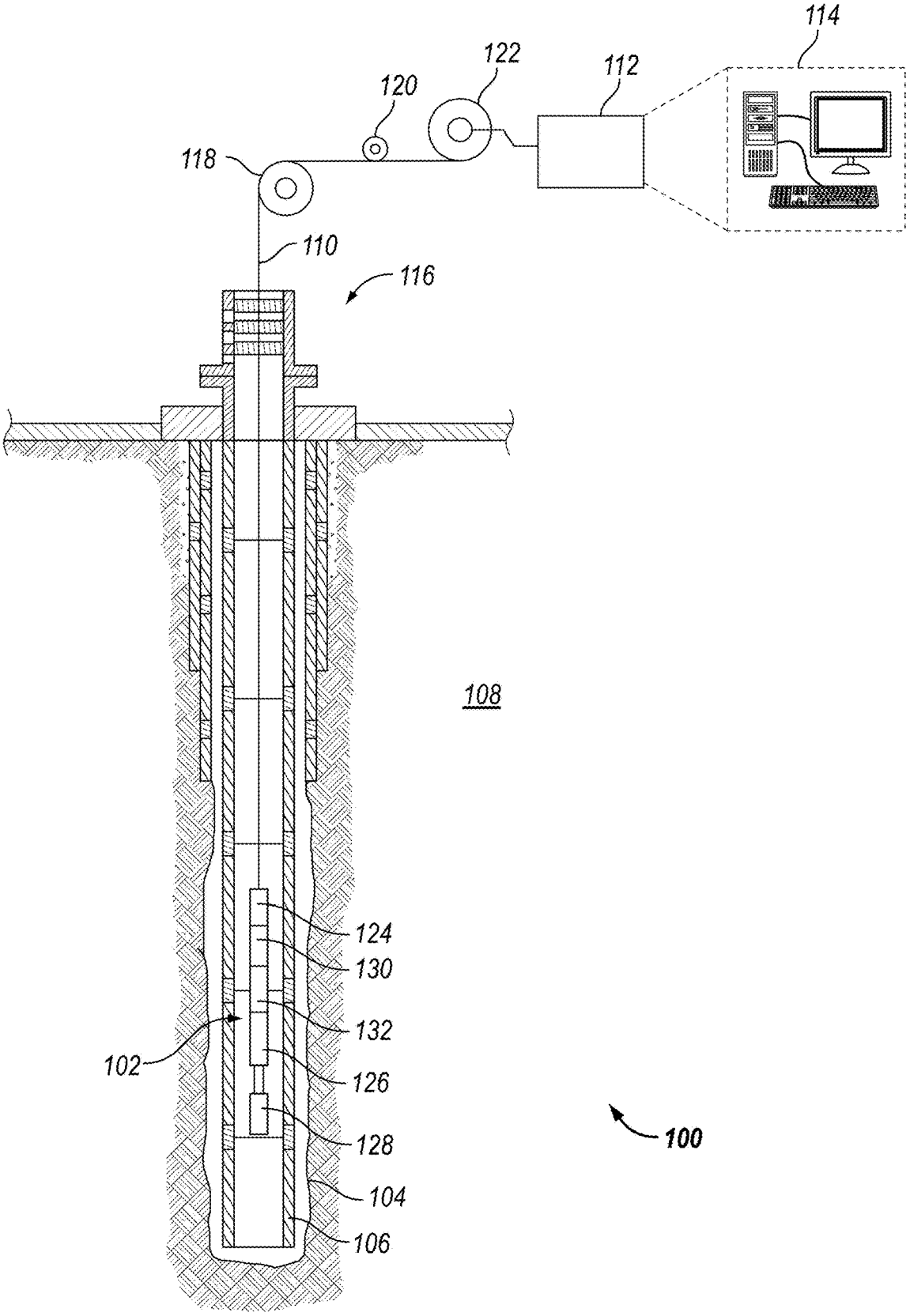
FIG. 1 illustrates an intervention tool disposed within a production string.

FIG. 1 illustrates an intervention operation 100, as disclosed herein, utilizing an intervention tool 102. FIG. 1 illustrates a cross-section of wellbore 104 with an intervention tool 102 traveling through production string 106. Wellbore 104 may traverse through subterranean formation 108 as a vertical well and/or a horizontal well. Intervention tool 102 may be suspended by a conveyance 110, which communicates power from a logging facility 112 to intervention tool 102 and communicates telemetry from intervention tool 102 to information handling system 114. In examples, intervention tool 102 may be operatively coupled to a conveyance 110 (e.g., wireline, slickline, coiled tubing, pipe, downhole tractor, and/or the like) which may provide mechanical suspension, as well as electrical connectivity, for intervention tool 102. Conveyance 110 and intervention tool 102 may extend within production string 106 to a depth within wellbore 104. Conveyance 110, which may comprise one or more electrical conductors, may exit wellhead 116, may pass around pulley 118, may engage odometer 120, and may be reeled onto winch 122, which may be employed to raise and lower intervention tool 102 in production string 106. Wellhead 116 may allow for entry into production string 106 and placement of intervention tool 102 at any desired location within production string 106. The position of intervention tool 102 may be monitored in a number of ways, including an inertial tracker in intervention tool 102 and a paid-out conveyance length monitor in logging facility 112.

Multiple such measurements may be desirable to enable the system to compensate for varying cable tension and cable stretch due to other factors. Information handling system 114 in logging facility 112 collects telemetry and position measurements and provides position-dependent logs of measurements from intervention tool 102 and values that may be derived therefrom. As illustrated, intervention tool 102 may comprise multiple devices for performing an intervention operation within production string 106. For example, intervention tool 102 may comprise an anchoring device 124, an actuating device 126, a shifting device 128, a sensor sub 130, and/or a power and telemetry sub 132. While not illustrated, intervention tool 102 may further comprise wheels, bow springs, fins, pads, or other centralizing mechanisms may be employed to keep intervention tool 102 near the borehole axis during intervention operations.

Intervention operations performed by intervention tool 102 may be controlled, at least in part by information handling system 114. For example, signals recorded by intervention tool 102 may be sent to information handling system 114 where they may be stored on memory and then processed. The processing may be performed real-time during data acquisition or after recovery of intervention tool 102. Processing may alternatively occur downhole on an information handling system disposed on intervention tool 102 or may occur both downhole and at surface. In some examples, signals recorded by intervention tool 102 may be conducted to information handling system 114 by way of conveyance 110. Information handling system 114 may process the signals, and the information contained therein may be displayed for an operator to observe and store for future processing and reference. Information handling system 114 may also contain an apparatus for supplying control signals and power to intervention tool 102.

In wireline operations 100, a digital telemetry system may be employed, wherein an electrical circuit may be used to both supply power to intervention tool 102 and to transfer data between information handling system 114 and intervention tool 102. A DC voltage may be provided to intervention tool 102 by a power supply located above ground level, and data may be coupled to the DC power conductor by a baseband current pulse system. Alternatively, intervention tool 102 may be powered by batteries located within the downhole tool assembly, and/or the data provided by intervention tool 102 may be stored within intervention tool 102, rather than transmitted to the surface intervention operations.

Figure 2:
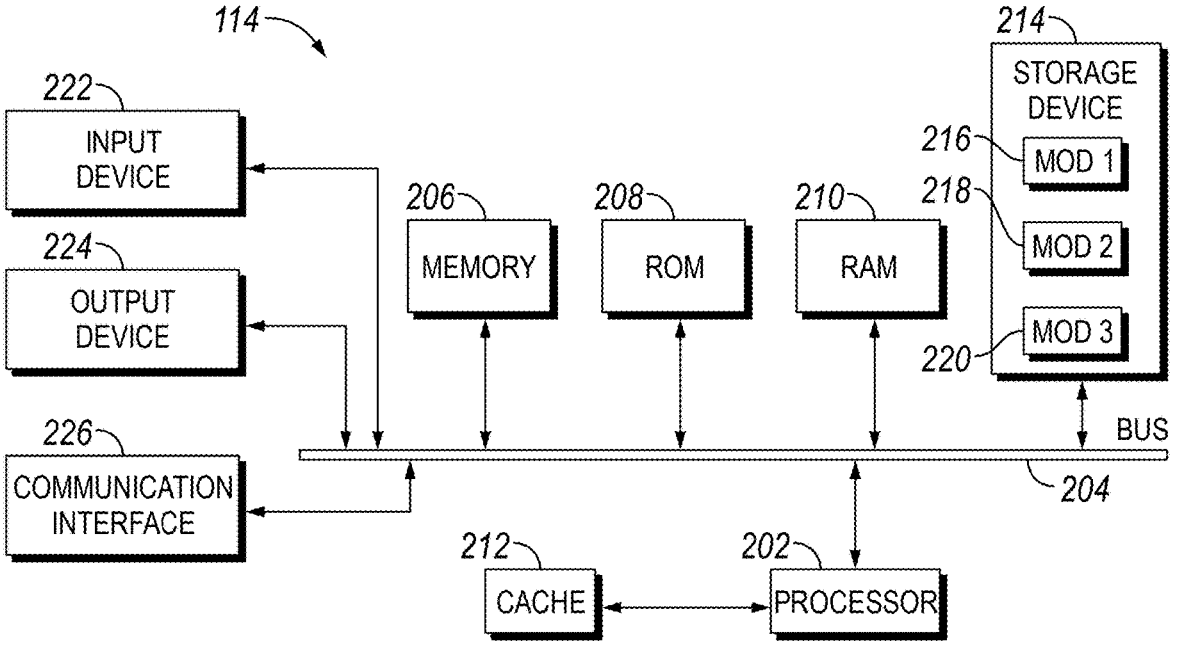
FIG. 2 illustrates a schematic of an information handling system.

FIG. 2 further illustrates an example of information handling system 114 which may be employed to perform various steps, methods, and techniques disclosed herein. Persons of ordinary skill in the art will readily appreciate that other system examples are possible. As illustrated, information handling system 114 includes a processing unit (CPU or processor) 202 and a system bus 204 that couples various system components including system memory 206 such as read only memory (ROM) 208 and random-access memory (RAM) 210 to processor 202. Processors disclosed herein may all be forms of this processor 202. Information handling system 114 may include a cache 212 of high-speed memory connected directly with, in close proximity to, or integrated as part of processor 202. Information handling system 114 copies data from memory 206 and/or storage device 214 (written 514 in FIG. 2) to cache 212 for quick access by processor 202. In this way, cache 212 provides a performance boost that avoids processor 202 delays while waiting for data. These and other modules may control or be configured to control processor 202 to perform various operations or actions. Other system memory 206 may be available for use as well. Memory 206 may include multiple different types of memory with different performance characteristics. It may be appreciated that the disclosure may operate on information handling system 114 with more than one processor 202 or on a group or cluster of computing devices networked together to provide greater processing capability. Processor 202 may include any general-purpose processor and a hardware module or software module, such as first module 216, second module 218, and third module 220 stored in storage device 214, configured to control processor 202 as well as a special-purpose processor where software instructions are incorporated into processor 202. Processor 202 may be a self-contained computing system, containing multiple cores or processors, a bus, memory controller, cache, etc. A multi-core processor may be symmetric or asymmetric. Processor 202 may include multiple processors, such as a system having multiple physically separate processors in different sockets, or a system having multiple processor cores on a single physical chip. Similarly, processor 202 may include multiple distributed processors located in multiple separate computing devices but working together such as via a communications network. Multiple processors or processor cores may share resources such as memory 206 or cache 212 or may operate using independent resources. Processor 202 may include one or more state machines, an application specific integrated circuit (ASIC), or a programmable gate array (PGA) including a field PGA (FPGA).

Each individual component discussed above may be coupled to system bus 204, which may connect each and every individual component to each other. System bus 204 may be any of several types of bus structures including a memory bus or memory controller, a peripheral bus, and a local bus using any of a variety of bus architectures. A basic input/output (BIOS) stored in ROM 208 or the like, may provide the basic routine that helps to transfer information between elements within information handling system 114, such as during start-up. Information handling system 114 further includes storage devices 214 or machine-readable storage media such as a hard disk drive, a magnetic disk drive, an optical disk drive, tape drive, solid-state drive, RAM drive, removable storage devices, a redundant array of inexpensive disks (RAID), hybrid storage device, or the like. Storage device 214 may include software modules 216, 218, and 220 for controlling processor 202. Information handling system 114 may include other hardware or software modules. Storage device 214 is connected to the system bus 204 by a drive interface. The drives and the associated machine-readable storage devices provide nonvolatile storage of machine-readable instructions, data structures, program modules and other data for information handling system 114. In one aspect, a hardware module that performs a particular function includes the software component stored in a tangible machine-readable storage device in connection with hardware components, such as processor 202, system bus 204, and so forth, to carry out a particular function. In another aspect, the system may use a processor and machine-readable storage device to store instructions which, when executed by the processor, cause the processor to perform operations, a method or other specific actions. The basic components and appropriate variations may be modified depending on the type of device, such as whether information handling system 114 is a small, handheld computing device, a desktop computer, or a computer server. When processor 202 executes instructions to perform "operations", processor 202 may perform the operations directly and/or facilitate, direct, or cooperate with another device or component to perform the operations.

As illustrated, information handling system 114 employs storage device 214, which may be a hard disk or other types of machine-readable storage devices which may store data that are accessible by a computer, such as magnetic cassettes, flash memory cards, digital versatile disks (DVDs), cartridges, random access memories (RAMs) 210, read only memory (ROM) 208, a cable containing a bit stream and the like, which may also be used in the exemplary operating environment. Tangible machine-readable storage media, machine-readable storage devices, or machine-readable memory devices, expressly exclude media such as transitory waves, energy, carrier signals, electromagnetic waves, and signals per se.

To enable user interaction with information handling system 114, an input device 222 represents any number of input mechanisms, such as a microphone for speech, a touch-sensitive screen for gesture or graphical input, keyboard, mouse, motion input, speech and so forth. Additionally, input device 222 may receive one or more measurements from logging tool 102, discussed above. An output device 224 may also be one or more of a number of output mechanisms known to those of skill in the art. In some instances, multimodal systems enable a user to provide multiple types of input to communicate with information handling system 114. Communications interface 226 generally governs and manages the user input and system output. There is no restriction on operating on any particular hardware arrangement and therefore the basic hardware depicted may easily be substituted for improved hardware or firmware arrangements as they are developed.

As illustrated, each individual component described above is depicted and disclosed as individual functional blocks. The functions these blocks represent may be provided through the use of either shared or dedicated hardware, including, but not limited to, hardware capable of executing software and hardware, such as a processor 202, that is purpose-built to operate as an equivalent to software executing on a general purpose processor. For example, the functions of one or more processors presented in FIG. 2 may be provided by a single shared processor or multiple processors. (Use of the term "processor" should not be construed to refer exclusively to hardware capable of executing software.) Illustrative embodiments may include microprocessor and/or digital signal processor (DSP) hardware, read-only memory (ROM) 208 for storing software performing the operations described below, and random-access memory (RAM) 210 for storing results. Very large-scale integration (VLSI) hardware embodiments, as well as custom VLSI circuitry in combination with a general-purpose DSP circuit, may also be provided.

Figure 3:
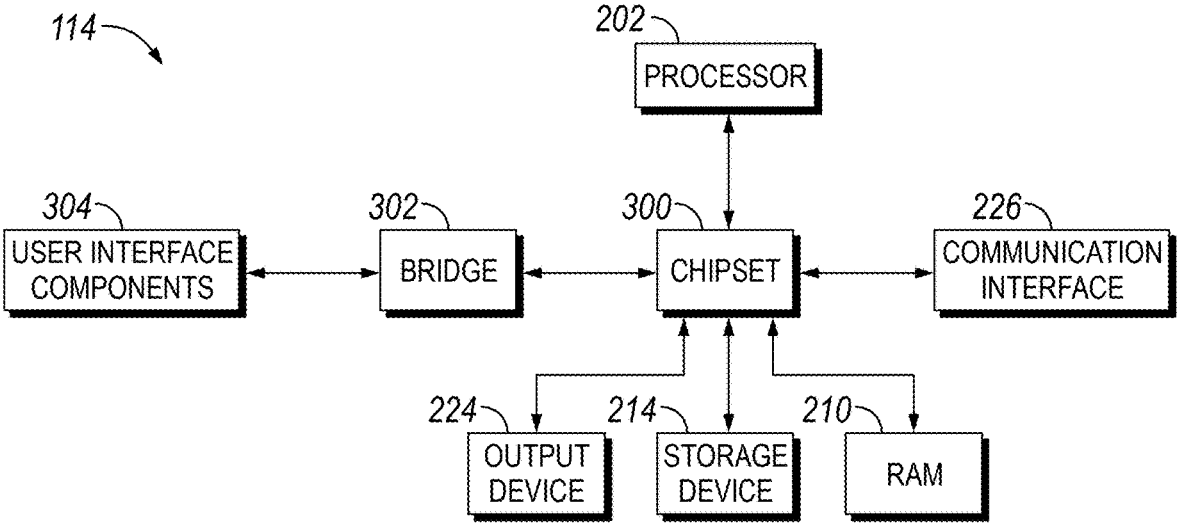
FIG. 3 illustrates a schematic of a chip set.

FIG. 3 illustrates an example of an information handling system 114 having a chipset architecture that may be used in executing the described method and generating and displaying a graphical user interface (GUI). Information handling system 114 is an example of computer hardware, software, and firmware that may be used to implement the disclosed technology. Information handling system 114 may include a processor 202, representative of any number of physically and/or logically distinct resources capable of executing software, firmware, and hardware configured to perform identified computations. Processor 202 may communicate with a chipset 300 that may control input to and output from processor 202. In this example, chipset 300 outputs information to output device 224, such as a display, and may read and write information to storage device 214, which may include, for example, magnetic media, and solid-state media. Chipset 300 may also read data from and write data to RAM 210. A bridge 302 for interfacing with a variety of user interface components 304 may be provided for interfacing with chipset 300. User interface components 304 may include a keyboard, a microphone, touch detection and processing circuitry, a pointing device, such as a mouse, and so on. In general, inputs to information handling system 114 may come from any of a variety of sources, machine generated and/or human generated.

Chipset 300 may also interface with one or more communication interfaces 226 that may have different physical interfaces. Such communication interfaces 226 may include interfaces for wired and wireless local area networks, for broadband wireless networks, as well as personal area networks. Some applications of the methods for generating, displaying, and using the GUI disclosed herein may include receiving ordered datasets over the physical interface or being generated by the machine itself by processor 202 analyzing data stored in storage device 214 or RAM 210. Further, information handling system 114 receives inputs from a user via user interface components 304 and executes appropriate functions, such as browsing functions by interpreting these inputs using processor 202.

In examples, information handling system 114 may also include tangible and/or non-transitory machine-readable storage devices for carrying or having computer-executable instructions or data structures stored thereon. Such tangible machine-readable storage devices may be any available device that may be accessed by a general purpose or special purpose computer, including the functional design of any special purpose processor as described above. By way of example, and not limitation, such tangible machine-readable devices may include RAM, ROM, EEPROM, CD-ROM or other optical disk storage, magnetic disk storage or other magnetic storage devices, or any other device which may be used to carry or store program code in the form of computer-executable instructions, data structures, or processor chip design. When information or instructions are provided via a network, or another communications connection (either hardwired, wireless, or combination thereof), to a computer, the computer properly views the connection as a machine-readable medium. Thus, any such connection is properly termed a machine-readable medium. Combinations of the above should also be included within the scope of the machine-readable storage devices.

Computer-executable instructions include, for example, instructions and data which cause a general-purpose computer, special purpose computer, or special purpose processing device to perform a certain function or group of functions. Computer-executable instructions also include programming modules that are executed by computers in stand-alone or network environments. Generally, program modules include routines, programs, components, data structures, objects, and the functions inherent in the design of special-purpose processors, etc. that perform particular tasks or implement particular abstract data types. Computer-executable instructions, associated data structures, and program modules represent examples of the program code for executing steps of the methods disclosed herein. The particular sequence of such executable instructions or associated data structures represents examples of corresponding acts for implementing the functions described in such steps.

In additional examples, methods may be practiced in network computing environments with many types of computer system configurations, including personal computers, hand-held devices, multi-processor systems, microprocessor-based or programmable consumer electronics, network PCs, minicomputers, mainframe computers, and the like. Examples may also be practiced in distributed computing environments where tasks are performed by local and remote processing devices that are linked (either by hardwired links, wireless links, or by a combination thereof) through a communications network. In a distributed computing environment, program modules may be located in both local and remote memory storage devices.

Figure 4:
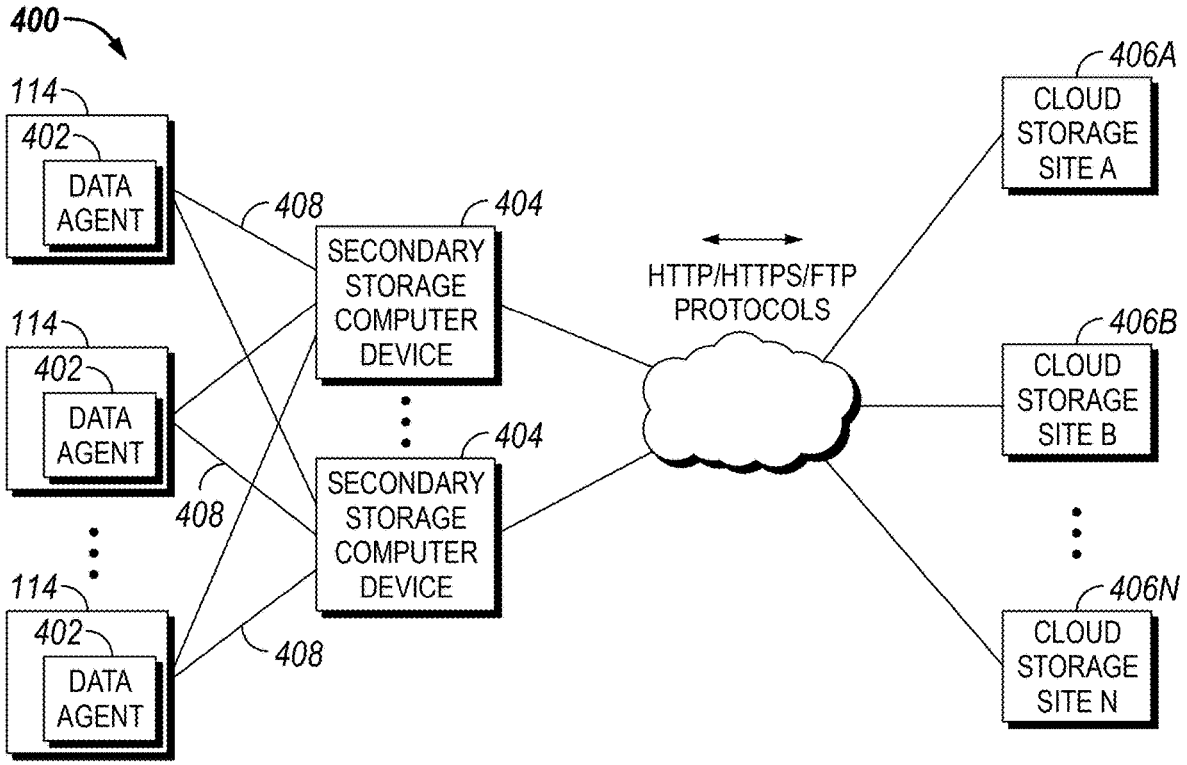
FIG. 4 illustrates a computing network.

FIG. 4 illustrates an example of one arrangement of resources in a computing network 400 that may employ the processes and techniques described herein, although many others are of course possible. As noted above, an information handling system 420, as part of their function, may utilize data, which includes files, directories, metadata (e.g., access control list (ACLS) creation/edit dates associated with the data, etc.), and other data objects. The data on the information handling system 420 is typically a primary copy (e.g., a production copy). During a copy, backup, archive or other storage operation, information handling system 420 may send a copy of some data objects (or some components thereof) to a secondary storage computing device 404 by utilizing one or more data agents 402.

A data agent 402 may be a desktop application, website application, or any software-based application that is run on information handling system 420. As illustrated, information handling system 420 may be disposed at any rig site, off site location, or repair and manufacturing center. The data agent may communicate with a secondary storage computing device 404 using communication protocol 408 in a wired or wireless system. Communication protocol 408 may function and operate as an input to a website application. In the website application, field data related to pre- and post-operations, notes, and the like may be uploaded. Additionally, information handling system 420 may utilize communication protocol 408 to access processed measurements, operational commands, and/or the like. This information is accessed from secondary storage computing device 404 by data agent 402, which is loaded on information handling system 420.

Secondary storage computing device 404 may operate and function to create secondary copies of primary data objects (or some components thereof) in various cloud storage sites 406A-N. Additionally, secondary storage computing device 404 may run determinative algorithms on data uploaded from one or more information handling systems 420, discussed further below. Communications between the secondary storage computing devices 404 and cloud storage sites 406A-N may utilize REST protocols (Representational state transfer interfaces) that satisfy basic C/R/U/D semantics (Create/Read/Update/Delete semantics), or other hypertext transfer protocol ("HTTP")-based or file-transfer protocol ("FTP")-based protocols (e.g., Simple Object Access Protocol).

In conjunction with creating secondary copies in cloud storage sites 406A-N, the secondary storage computing device 404 may also perform local content indexing and/or local object-level, sub-object-level or block-level duplication when performing storage operations involving various cloud storage sites 406A-N. Cloud storage sites 406A-N may further record, maintain, and store operational data. As well as providing outputs from determinative algorithms that are located in cloud storage sites 406A-N. In a non-limiting example, this type of network may be utilized as a platform to store, backup, analyze, import, perform, extract, transform and load ("ETL") processes, mathematically process, and visualize data from intervention tool 102 during and/or for well intervention operations.

Well intervention operations may comprise opening and closing ball valves by using an intervention tool 102. Intervention tool 102 may comprise an anchoring device 124, an actuating device 126, a, a sensor sub 130, and/or a power and telemetry sub 132 (e.g., referring to FIG. 1). During intervention operations, intervention tool 102 may provide push or pull forces to open and close a ball valve. Currently, personnel may control different operations of intervention tool 102 by sending commands to intervention tool 102 from information handling system 114. However, the use of personnel may leave margins for possible human error, leading to failure of intervention operations and/or possible failure and loss of intervention tool 102.

Disclosed below are methods and systems utilized to automate intervention operations using intervention tool 102. Automation may prevent human error and failure of intervention operations and possible loss of intervention tool 102 by preconfiguring parameters for intervention tool 102 to operate during a given intervention operation. In the event of unforeseen circumstances, personnel at the surface may abort the operation and intervention tool 102 may automatically release itself from wellbore 104 and prepare to be removed from wellbore 104. As discussed below, methods and systems for automation may comprise predefined control algorithms and hierarchical state machines for seeking and shifting as well as releasing and aborting. Further, peer-to-peer communication between devices that form intervention tool 102 may allow for workflows, discussed below, to operate smoothly. Which may allow for intervention tool 102 to self-manage and control the devices within intervention tool 102.

Figure 5:
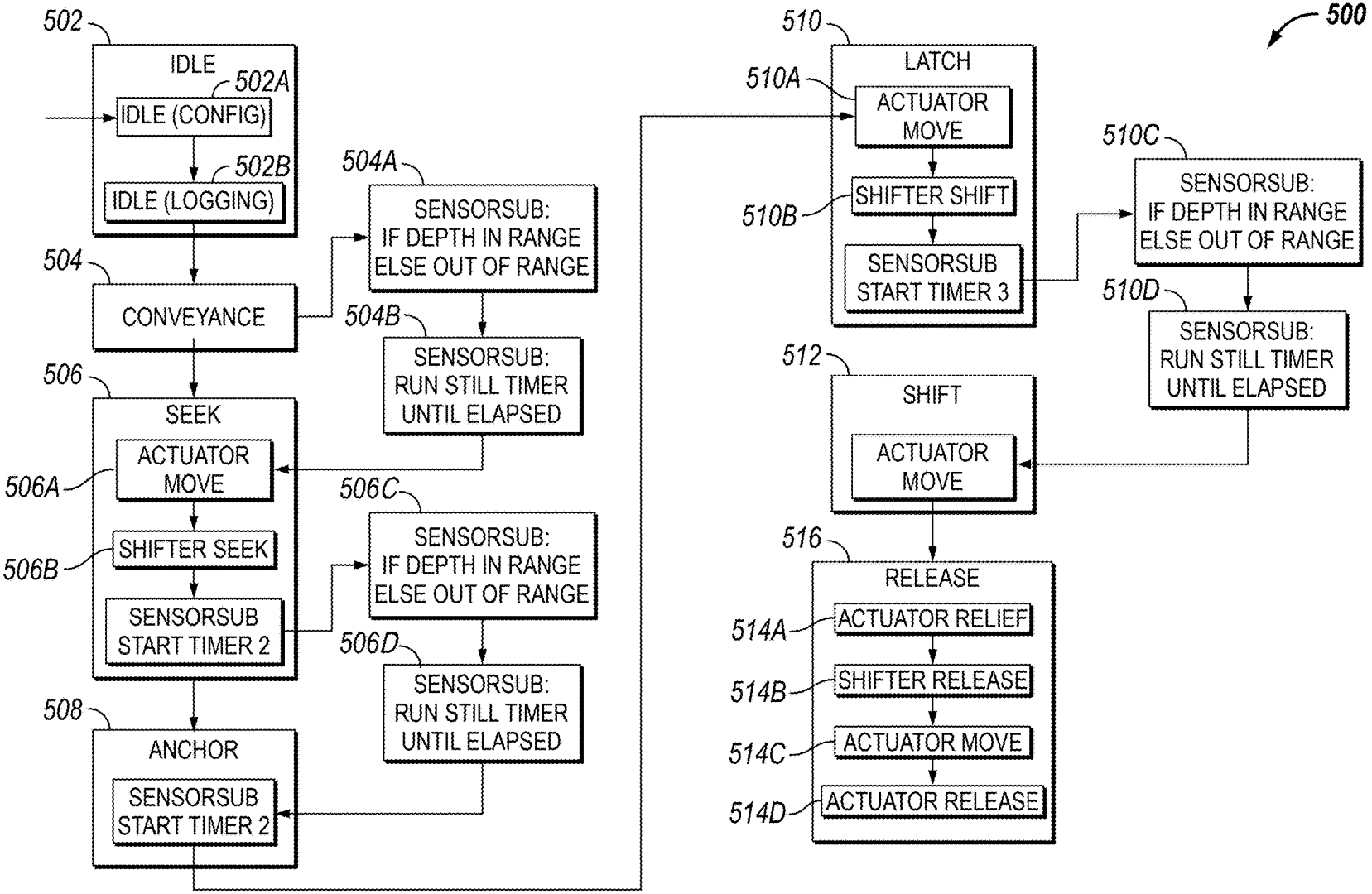
FIGS. 5 & 6 are workflows for downhole intervention operations.

FIG. 5 illustrates an intervention operation workflow 500 for intervention tool 102 (e.g., referring to FIG. 1). Described herein, intervention operation workflow 500 pertains to a sliding sleeve shifting operation. However, the methods and systems described herein may also be utilized for plug setting operations, plug retrieval operations, and/or fishing operations. It should be noted that workflow 500 may be performed at least in part on information handling system 114 (e.g., referring to FIG. 1) in peer-to-peer communication between devices on intervention tool 102. As noted above, information handling system 114 may be disposed at surface, on intervention tool 102, or at least in part on intervention tool 102 and at least in part at surface. As illustrated, workflow 500 may begin with block 502. Block 502 may comprise operations in which intervention tool 102 may be idle such as stationery or idle in that no operations are being performed by intervention tool 102. For example, in 502A, intervention tool 102 is idle for configuration of intervention tool 102. This configuration may be either mechanical configuration or software configuration. Each configuration may be performed to prepare intervention tool 102 for any type of intervention operation. In 502B, intervention tool 102 may be idle as intervention tool 102 may be disposed downhole to an intervention operation. For example, intervention tool 102 may be attached to a conveyance 110, which may lower or raise intervention tool 102 within wellbore 104. As intervention tool 102 may be either raised or lowered, intervention tool 102 may be "idle" as the devices that form intervention tool 102 may not be operating as designed. It should be noted that during movement of intervention tool 102 within wellbore 104, logging operations may be performed by other tools disposed on conveyance 110.

In block 504, intervention tool 102 (e.g., referring to FIG. 1) may traverse to a location within wellbore 104 (e.g., referring to FIG. 1) in which intervention operations may be performed. In block 504, specifically 504A, sensor sub 130 (e.g., referring to FIG. 1) may take measurements to identify the location of intervention tool 102 within wellbore 104. In examples, measurements taken to identify the location of intervention tool 102 within wellbore 104 may be depth measurements taken by a casing collar locator sensor. In block 504A, if intervention tool 102 is not at an identified depth, intervention tool 102 may continue to be lowered to the pre-determined depth. This depth may have been predetermined during configuration in 502A. Once the predetermined depth has been reached, intervention tool 102 may be held at least in part stationery within wellbore 104 and workflow 500 may move to 502B. It should be noted that stationery in this disclosure is not defined as completely motionless in any direction. To the contrary, stationery is defined as intervention tool 102 staying relatively in the same area even though intervention tool 102 may sway or move up and down slightly within wellbore 104. Further, as long as intervention tool 102 stays within several meters from the pre-determined location, this is considered stationary. Once stationary, workflow 500 may move to 504B. In 504B, a timer, software or mechanical, within sensor sub 130 may begin a pre-determined countdown of time. This time period may be referred to as a still period, such as a first, second, third, etc. still period. If during this count down intervention tool 102 stays stationary, then workflow 500 may move to block 506.

Block 506 may perform seek operations with one or more devices disposed on intervention tool 102. A seeking operation may comprise matching traversing shifting device 128 through wellbore 104 to a sliding sleeve or other downhole tool. As disused herein, seeking operations may be performed by expanding shifting device 128 with just enough current such that it is able to traverse through wellbore 104, sliding sleeve, and/or downhole tool using wireline operations discussed above until its key latches into a profile of the sliding sleeve or downhole tool. During seek operations in block 506, actuating device 126 may be deployed. For example, as intervention tool 102 is stationary, as in block 504, actuating device 126 in 506A may operate by extending outwardly from a starting position. This may be performed by rotating a threaded rod clockwise or counter-clockwise to extend or retract the rod. The rod may be connected to and/or controlled by a motor disposed in actuating device 126. The motor may be PMSM/BLDC motors, which may be disposed in anchoring device 124, actuating device 126, and/or shifting device 128. During operations, when a PMSM/BLDC motor controller rotates the motor by one revolution, the controller counts that revolution (i.e., motor counts), and increments the revolution count after every subsequent motor revolution. If the motor reverses direction then the rev-count is decremented instead. If the motor is connected to a lead-screw/linear-drive then every revolution produces a specific linear displacement of its threaded rod or nut—the total rod/nut displacement is the product of the threaded rod revolutions and the displacement per revolution. The threaded rod may connect actuating device 126 to shifting device 128. The rotation of the threaded rod may be measured by motor counts as the motor rotates the threaded rod clockwise or counterclockwise. It should be noted that actuating device 126 may extend shifting device 128 in wellbore 104 past a designated area. The designated area may be a location of a sliding sleeve within wellbore 104. After extension in 506A of actuating device 126, shifting device 128 may extend shifting keys radially away from shifting device 128 in 506B. Once shifting keys have been extended, actuating device 126 may begin to retract shifting device 128 in 506B. During retraction of shifting device 128 by actuating device 126, the extended shifting keys may press against the sliding sleeve. If the shifting keys in 506C do not identify a profile of the sliding sleeve in which the shifting keys may set, block 506 may be repeated, starting with 506A.

Profile identification may be performed by checking wireline tension (lbf) from sensor sub 130 and confirmed by current (milli Ampere) going through actuating device 126. These measured values may be sent to and viewed at information handling system 114. If there is a profile engaged by the shifting keys, measurements may show tension build up on sensor sub 130 during seek operations and it is confirmed by current measurements of actuating device 126 during shifting operations discussed below. However, if the shifting keys identify the profile of the sliding sleeve in 506C, a mechanical or software timer may begin a countdown in 506D. This time period may be referred to as a still period, such as a first, second, third, etc. still period. Intervention tool 102 may identify when shifting keys have set within sliding sleeve 506D by an increase in force counteracting the pull of actuating device 126. At such time, intervention tool 102 may not have enough force exerted by actuating device 126 to overcome the opposing force of the stationary sliding sleeve. Once the increase in force has been sensed and/or measured by intervention tool 102, actuating device 126 may stop retraction of shifting device 128 and a mechanical or software-based clock may begin a countdown. The countdown may allow time to determine if the shifting keys are set within the sliding sleeve or have just become stuck or lodged within wellbore 104. After the expiration of the countdown, workflow 500 may move to preparations of intervention tool 102 to move the sliding sleeve.

In block 508, anchoring device 124 may begin operations by expanding radially into wellbore 104. This may be performed after 506D and the expiration of the countdown, discussed above. As anchoring device 124 expands within wellbore 104, pressure may build within anchoring device 124 as counter acting force is applied to anchoring device 124 when engaged with walls of wellbore 104. Once a pre-determined applied force from anchoring device 124 against the walls of wellbore 104 is reached, anchoring device 124 may stop expansion within wellbore 104. The force measurement may be measured by a pressure sensor built-in to anchoring device 124. In other examples, the force may also be derived given measured pressure and anchor pad's surface area. This may allow intervention tool 102 to move to additional operations to move the sliding sleeve.

In block 510, a latching operation may begin with one or more devices disposed on intervention tool 102. As noted above, shifting device 128 may have stopped retracting in block 506. Now that anchoring device 124 has expanded in block 508, shifting device 128 may continue to expand radially into the identified profile ID of the shifting sleeve. To perform this function in 510A, actuating device 126 may extend slightly away from intervention tool 102 as in 506A. In 510B, shifting device 128 may extend radially into the sliding sleeve. The pressure being exerted against the sliding sleeve may be measured. The force experienced may be estimated by measuring motor current used to expand shifting device 128. Motor torque is linearly correlated with motor phase current. If that motor is connected to a lead-screw/linear-drive then the resulting linear force is linearly correlated to the motor phase current. By measuring and plotting the motor phase current against linear force using a reference force-gauge, the rate of conversion of phase amps to pounds force (gain) can be determined, including the initial phase-current investment required to get the motor turning under no-load conditions (offset). Resulting force is then the product of phase-current (less the offset) and gain. In 510C measurements may be performed by measuring motor current to determine if shifting device 128 has fully extended radially to a pre-determined distance from shifting device 128. If a full extension is measured, then a mechanical or software countdown begins in 510D. If the full extension is not accomplished, then workflow 500 may restart the process at 510A. After full extension and pre-determined outward pressure is measured and confirmed by sensor sub 130, then a shifting operation may be performed.

In block 512, a shifting operation may be performed to open or close sliding sleeve 700 (e.g., referring to FIGS. 7A-7D). To perform the operation, actuating device 126 may continue to retract shifting device 128. As shifting device 128 has fully latched to the sliding sleeve in block 510, the sliding sleeve 700 may move with shifting device 128. Additionally, as anchoring device 124 has been deployed in block 508, intervention tool 102 may stay stationary and provide a base from which actuating device 126 may utilize to retract shifting device 128. In examples, sliding sleeve 700 may only be opened partially. In such examples, intervention tool 102 is pre-programmed in block 502 for actuating device 126 to retract shifting device 128 (and thus the sliding sleeve) a pre-programmed distance. In other examples, sliding sleeve 700 may be opened fully. In such example, a pre-programmed distance, as discussed above, to fully open the sliding sleeve may be utilized or an increase in pressure exerted upon actuating device 126 may be measured.

Figure 7A:
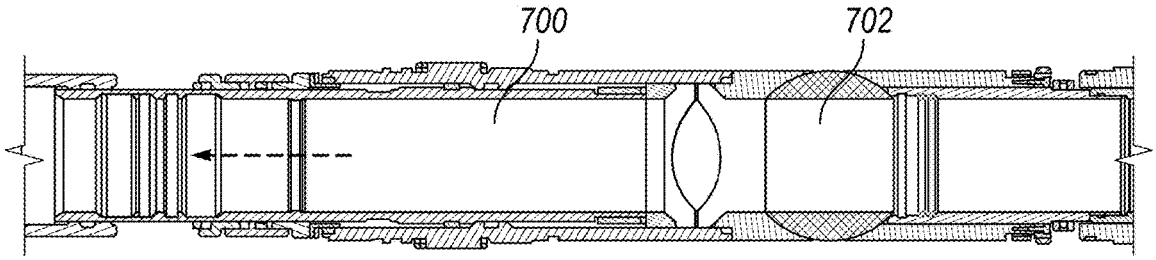
FIG. 7A-7D illustrates opening and closing a ball valve in an intervention operation.
Figure 7B:
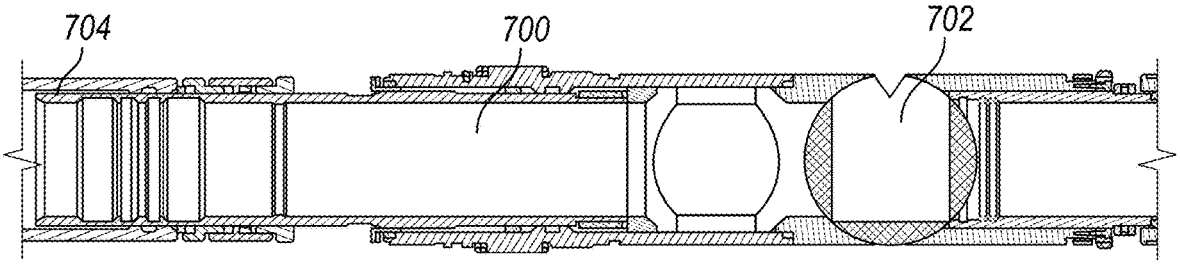
Figure 7C:
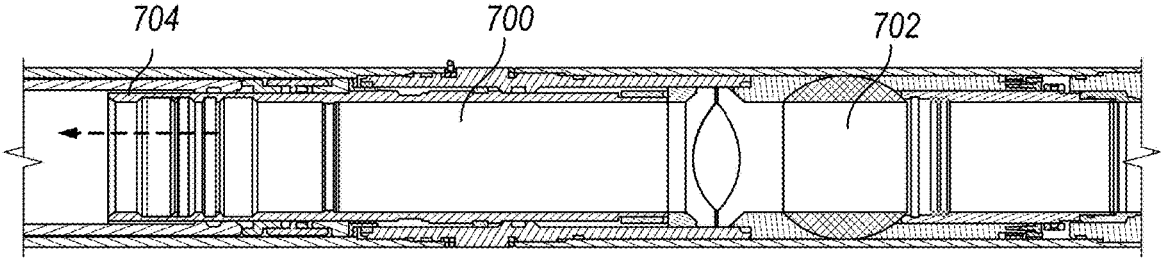
Figure 7D:
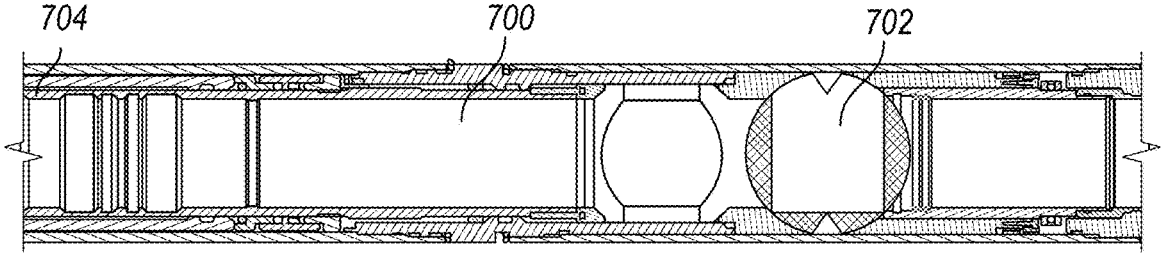

FIGS. 7A-7D illustrate the movement of sliding sleeve 700 to actuate a ball valve 702. It should be noted that intervention tool 102 is not illustrated. In FIG. 7A, sliding sleeve 700 is mechanically connected to ball valve 702. Ball valve 702 is in an open position. Once intervention tool 102 (e.g., referring to FIG. 1), is attached to sliding sleeve 700, sliding sleeve 700 may move laterally within wellbore 104 to a first position, as illustrated in FIG. 7B. This first position may close ball valve 702. Additionally, sliding sleeve 700 may attach to an outer sleeve 704. During intervention operations, intervention tool 102 may open ball valve 702 by moving sliding sleeve 700 toward ball valve 702, as illustrated in FIG. 7C. As sliding sleeve 700 is now attached to outer sleeve 704, outer sleeve 704 moves with sliding sleeve as one assembly. In FIG. 7D, ball valve 702 is permanently closed by moving sliding sleeve 700 using intervention tool 102 away from ball valve 702. It is permanently shut as shear pins 706, disposed in sliding sleeve 700 are sheard off by outer sleeve 704. This may lock sliding sleeve 700 to outer sleeve 704 and prevent sliding sleeve 700 from being able to move back to ball valve 702, permanently closing ball valve 702. The increase in pressure may be created as the sliding sleeve 700 may not be mechanically or physically able to move any further, thus, pressure increases on actuating device 126 as it cannot move sliding sleeve 700. After sliding sleeve 700 has been moved to the pre-determined location, shifting device 128 may be detached from the sliding sleeve 700.

Shifting device 128 may detach from the sliding sleeve in block 516. To detach from the sliding sleeve, in 514A actuating device 126 may create relief by extending shifting device 128 from intervention tool 102 as in 506A. The extension by actuating device 126 may be slight but may allow space to form between the shifting keys and the profile ID of the shifting sleeve. In 514B, the shifting keys may release from the sliding sleeve when the shifting keys retract toward shifting device 128. Once the shifting keys have fully retracted in 514B, actuating device 126 may fully retract shifting device 128 to intervention tool 102 in 514C. In 514D, after actuating device 126 has fully retracted shifting device 128 to intervention tool 102, anchoring device 124 may retract back to intervention tool 102, which may release intervention tool 102 from wellbore 104. In 514E, after anchoring device 124 has fully retracted, intervention tool 102 may move back into an idle mode, allowing personnel to move intervention tool 102 to surface, up wellbore 104, or down wellbore 104 for further operations.

Figure 6:
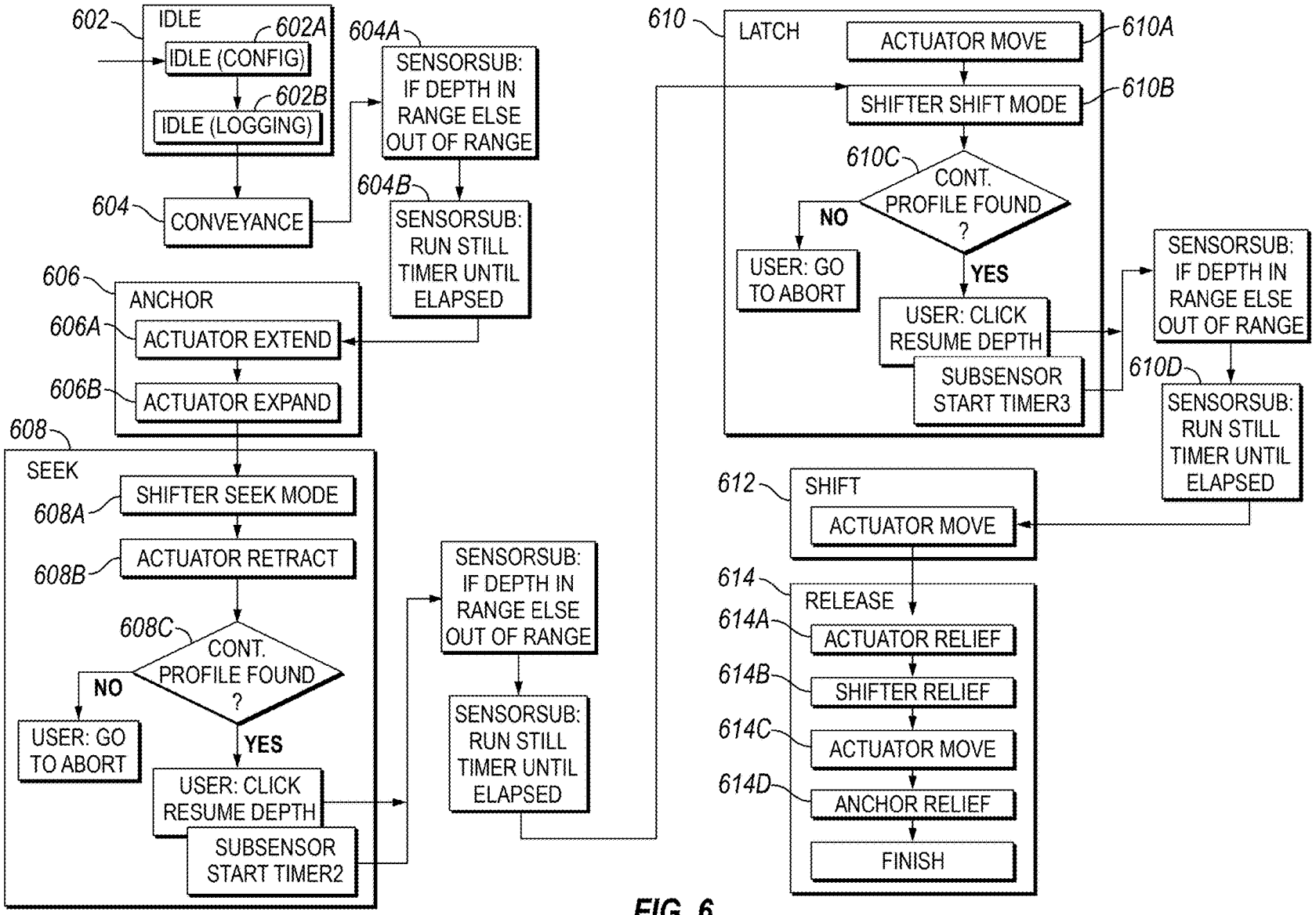

FIG. 6 illustrates an intervention operation workflow 600 for intervention tool 102. It should be noted that workflow 600 may be performed at least in part on information handling system 114 (e.g., referring to FIG. 1) in peer-to-peer communication between devices on intervention tool 102. As noted above, information handling system 114 may be disposed at surface, on intervention tool 102, or at least in part on intervention tool 102 and at least in part at surface. As illustrated, workflow 600 may begin with block 602. Block 602 may comprise operations in which intervention tool 102 may be idle such as stationery or idle in that no operations are being performed by intervention tool 102. For example, in 602A, intervention tool 102 is idle for configuration of intervention tool 102. This configuration may be either mechanical configuration or software configuration. Each configuration may be performed to prepare intervention tool 102 for any type of intervention operation. In 602B, intervention tool 102 may be idle as intervention tool 102 may be disposed downhole to an intervention operation. For example, intervention tool 102 may be attached to a conveyance 110, which may lower or raise intervention tool 102 within wellbore 104. As intervention tool 102 may be either raised or lowered, intervention tool 102 may be "idle" as the devices that form intervention tool 102 may not be operating as designed. It should be noted that during movement of intervention tool 102 within wellbore 104, logging operations may be performed by other tools disposed on conveyance 110.

In block 604, intervention tool 102 may traverse to a location within wellbore 104 in which intervention operations may be performed. In block 604, specifically 604A, sensor sub 130 may be taking measurements to identify the location of intervention tool 102 within wellbore 104. In block 604A, if intervention tool 102 is not at an identified depth, intervention tool 102 may continue to be lowered to the pre-determined depth. This depth may have been pre-determined during configuration in 602A. Once the pre-determined depth has been reached, intervention tool 102 may be held at least in part stationary within wellbore 104 and workflow 600 may move to 602A. It should be noted that stationery in this disclosure is not defined as completely motionless in any direction. To the contrary, stationery is defined as intervention tool 102 staying relatively in the same area even though intervention tool 102 may sway or move up and down slightly within wellbore 104. Further, as long as intervention tool 102 stays within several meters from the pre-determined location, this is considered stationary. Once stationary, workflow 600 may move to 604B. In 604B, a timer, software or mechanical, within sensor sub 130 may begin a pre-determined count down of time. This time period may be referred to as a still period, such as a first, second, third, etc. still period. If during this count down intervention tool 102 stays stationary, then workflow 600 may move to block 606.

In block 606, an anchoring operation may be performed by anchoring device 124. This may be performed after 602B and the expiration of the countdown, discussed above. In 606A, actuating device 126 may extend shifting device 128 past a sliding sleeve. For example, as intervention tool 102 is stationary, as in block 608, actuating device 126 in 606A may operate by extending outwardly from a starting position. This may be performed by a piston rod that may extend mechanically or hydraulically within intervention tool 102. It should be noted that actuating device 126 may be extending shifting device 128 in wellbore 104 past a designated area. The designated area may be a location of a sliding sleeve within wellbore 104. By moving shifting device 128 past sliding sleeve with actuating device 126, shifting device 128 may be prepared for further shifting operations discussed below. After extension of shifting device 128, anchoring device 124 may be engaged to wellbore 104. In 606B, anchoring device 124 expands within wellbore 104, pressure may build within anchoring device 124 as counter acting force is applied to anchoring device 124 when engaged with walls of wellbore 104. Once a pre-determined applied force from anchoring device 124 against the walls of wellbore 104 is reached, anchoring device 124 may stop expansion within wellbore 104. This may allow intervention tool 102 to perform seek operations in which shifting device 128 may be fit to sliding sleeve.

Block 608 may perform seek operations with one or more devices disposed on intervention tool 102. As noted above, in anchoring operations of block 606, actuating device 126 may have extended shifting device 128 in 606A. After extension in 606A of actuating device 126, shifting device 128 may extend shifting keys radially away from shifting device 128 in 608A. Once shifting keys have been extended, actuating device 126 may begin to retract shifting device 128 in 608B. During retraction of shifting device 128 by actuating device 126, the extended shifting keys may press against the sliding sleeve. If the shifting keys in 608C do not identify a profile, as described above, of the sliding sleeve in which the shifting keys may set, block 606 may be repeated, starting with 606A. However, if the shifting keys identify the profile of the sliding sleeve in 606C, a mechanical or software timer may begin a countdown. This time period may be referred to as a still period, such as a first, second, third, etc. still period. After completion of the countdown, a latching operation may begin.

In block 610, a latching operation may begin with one or more devices disposed on intervention tool 102. As noted above, shifting device 128 may have stopped retracting in block 606. Now that anchoring device 124 has expanded in block 608, shifting device 128 may continue to expand radially into the identified profile ID of the shifting sleeve. To perform this function in 610A, actuating device 126 may extend slightly away from intervention tool 102 as in 606A. In 610B, shifting device 128 may extend radially into the sliding sleeve. The pressure being exerted against the sliding sleeve may be measured or correlated from other electrical parameters or obtained from other devices disposed on intervention tool 102 via peer-to-peer communication. In 610C measurements may be performed by sensor sub 130 to determine if shifting device 128 has fully extended radially to a pre-determined distance from shifting device 128. If a full extension is not measured, then block 606 may be repeated, starting with 606A. If a full extension is measured, then a mechanical or software countdown begins in 610D. After full extension a pre-determined outward pressure is measured and confirmed by sensor sub 130, then a shifting operation may be performed. It should be noted that the outward pressure may be determined by measuring a phase-current in the motor running the pump that pressurizes the hydraulics driving the extension within shifter.

In block 612, a shifting operation may be performed to open or close the sliding sleeve 700, using the methods and systems described in FIGS. 7A-7D. To perform the operation, actuating device 126 may continue to retract shifting device 128. As shifting device 128 has fully latched to sliding sleeve 700 in block 610, the sliding sleeve may move with shifting device 128. Additionally, as anchoring device 124 has been deployed in block 606, intervention tool 102 may stay stationary and provide a base from which actuating device 126 may utilize to retract shifting device 128. In examples, the sliding sleeve may only be opened partially. In such examples, intervention tool 102 is pre-programmed in block 602 for actuating device 126 to retract shifting device 128 (and thus the sliding sleeve) a pre-programmed distance. In other examples, sliding sleeve 700 may be opened fully. In such example, a pre-programmed distance, as discussed above, to fully open sliding sleeve 700 may be utilized or an increase in pressure exerted upon actuating device 126 may be measured. The increase in pressure may be created as sliding sleeve 700 may not be mechanically or physically able to move any further, thus, pressure increases on actuating device 126 as it cannot move sliding sleeve 700. After sliding sleeve 700 has been moved to the pre-determined location, shifting device 128 may be detached from sliding sleeve 700.

Shifting device 128 may detach from sliding sleeve 700 in block 614. To detach from sliding sleeve 700, in 614A actuating device 126 may create relief by extending shifting device 128 from intervention tool 102 as in 606A. The extension by actuating device 126 may be slight but may allow space to form between the shifting keys and the profile ID of the shifting sleeve. In 614B, the shifting keys may release from sliding sleeve 700 when the shifting keys retract toward shifting device 128. Once the shifting keys have fully retracted in 614B, actuating device 126 may fully retract shifting device 128 to intervention tool 102 in 614C. In 614D, after actuating device 126 has fully retracted shifting device 128 to intervention tool 102, anchoring device 124 may retract back to intervention tool 102, which may release intervention tool 102 from wellbore 104. In 614E, after anchoring device 124 has fully retracted, intervention tool 102 may move back into an idle mode, allowing personnel to move intervention tool 102 to surface, up wellbore 104, or down wellbore 104 for further operations.

Statement 1: A method may comprise configuring an intervention tool for an intervention operation, disposing the intervention tool into a wellbore, conveying the intervention tool to a first location in the wellbore, and running a still period. The method may further comprise performing a seek operation automatically controlled at least in part by an information handling system disposed within the intervention tool after the still period, performing an anchoring operation automatically controlled at least in part with the information handling system after the seek operation to anchor the intervention tool to the wellbore, and performing the intervention operation automatically controlled at least in part by the information handling system with the intervention tool.

Statement 2: The method of statement 1, wherein the intervention operation is a sliding sleeve shifting operation, a plug setting operation, a plug retrieval operation, or a fishing operation.

Statement 3: The method of statement 1 or statement 2, wherein the seek operation is performed to identify a location of a sliding sleeve.

Statement 4: The method of any previous statement 1-3, further comprising performing a shifting operation to shift a sliding sleeve with the intervention tool.

Statement 5: The method of statement 4, further comprising an outer sleeve connected to the sliding sleeve.

Statement 6: The method of statement 5, further comprising a ball valve that is connected to the outer sleeve.

Statement 7: The method of any previous statements 1-4, further comprising a second still period between the seek operation and the anchoring operation.

Statement 8: The method of any previous statements 1-4 or 7, further comprising a latching of the intervention tool to a sliding sleeve.

Statement 9: The method of statement 8, further comprising a third still period between the latching and the shifting operation.

Statement 10: The method of any previous statements 1-4, 7, or 9, further comprising two or more still periods during intervention operations.

Statement 11: A non-transitory machine-readable medium having data stored therein representing a software executable by a computer, the software executable comprising instructions may be configured to instruct an intervention tool to run a still period when the intervention tool is at a first location in a wellbore or instruct the intervention tool to perform a seek operation automatically after the still period to identify a location of sliding sleeve. The instructions may further be configured to instruct the intervention tool to perform an anchoring operation automatically after the seek operation and instruct the intervention tool to perform a shifting operation automatically after the anchoring operation.

Statement 12: The instructions of statement 11, further wherein the intervention operation is a sliding sleeve shifting operation, a plug setting operation, a plug retrieval operation, or a fishing operations.

Statement 13: The instructions of statements 11 or 12, wherein the seek operation is performed to identify a location of a sliding sleeve.

Statement 14: The instructions of any previous statements 11-13, wherein the shifting operation is performed to shift a sliding sleeve with the intervention tool.

Statement 15: The instructions of statement 14, wherein an outer sleeve connected to the sliding sleeve.

Statement 16: The instructions of statement 15, wherein a ball valve that is connected to the outer sleeve.

Statement 17: The instructions of any previous statements 11-14, wherein the instructions further comprising a second still period between the seek operation and the anchoring operation.

Statement 18: The instructions of any previous statements 11-14 or 17, wherein the instructions further comprising a latching of the intervention tool to a sliding sleeve.

Statement 19: The instructions of statement 18, wherein the instructions further comprising a third still period between the latching and the shifting operation.

Statement 20: The instructions of any previous statements 11-14, 17, or 18, wherein the instructions further comprising two or more still periods during intervention operations.

As discussed above, improvements over current technology are found in the predefined control algorithms and hierarchical state machines for seeking and shifting as well as releasing and aborting. Peer-to-Peer (P2P) communication among tools: one master tool managing and controlling other tools. Hybrid depth-based and time-based trigger mechanisms to start and resume automation algorithms.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended on the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. A method comprising:

configuring an intervention tool for an intervention operation;

disposing the intervention tool into a wellbore;

conveying the intervention tool to a first location in the wellbore;

running a still period;

performing a seek operation automatically controlled at least in part by an information handling system disposed within the intervention tool after the still period;

performing an anchoring operation automatically controlled at least in part with the information handling system after the seek operation to anchor the intervention tool to the wellbore, wherein performing the anchoring operation automatically is based at least in part on a depth measurement; and performing the intervention operation automatically controlled at least in part by the information handling system with the intervention tool.

2. The method of claim 1, wherein the intervention operation is a sliding sleeve shifting operation, a plug setting operation, a plug retrieval operation, or a fishing operation.

3. The method of claim 1, wherein the seek operation is performed to identify a location of a sliding sleeve.

4. The method of claim 1, further comprising performing a shifting operation to shift a sliding sleeve with the intervention tool.

5. The method of claim 4, further comprising an outer sleeve connected to the sliding sleeve.

6. The method of claim 5, further comprising a ball valve that is connected to the outer sleeve.

7. The method of claim 1, further comprising a second still period between the seek operation and the anchoring operation.

8. The method of claim 1, further comprising a latching of the intervention tool to a sliding sleeve.

9. The method of claim 8, further comprising a third still period between the latching and the shifting operation.

10. The method of claim 1, further comprising two or more still periods during intervention operations.

11. A non-transitory machine-readable medium having data stored therein representing a software executable by a computer, the software executable comprising instructions configured to:

instruct an intervention tool to run a still period when the intervention tool is at a first location in a wellbore;

instruct the intervention tool to perform a seek operation automatically after the still period;

instruct the intervention tool to perform an anchoring operation automatically after the seek operation, wherein performing the anchoring operation automatically is based at least in part on a depth measurement; and instruct the intervention tool to perform a shifting operation automatically after the anchoring operation.

12. The instructions of claim 11, further wherein the intervention operation is a sliding sleeve shifting operation, a plug setting operation, a plug retrieval operation, or a fishing operation.

13. The instructions of claim 11, wherein the seek operation is performed to identify a location of a sliding sleeve.

14. The instructions of claim 11, wherein the shifting operation is performed to shift a sliding sleeve with the intervention tool.

15. The instructions of claim 14, wherein an outer sleeve connected to the sliding sleeve.

16. The instructions of claim 15, wherein a ball valve that is connected to the outer sleeve.

17. The instructions of claim 11, wherein the instructions further comprising a second still period between the seek operation and the anchoring operation.

18. The instructions of claim 11, wherein the instructions further comprising a latching of the intervention tool to a sliding sleeve.

19. The instructions of claim 18, wherein the instructions further comprising a third still period between the latching and the shifting operation.

20. The instructions of claim 11, wherein the instructions further comprising two or more still periods during intervention operations.

21. A method comprising:

configuring an intervention tool for an intervention operation;

disposing the intervention tool into a wellbore;

conveying the intervention tool to a first location in the wellbore;

running a still period;

performing a seek operation automatically controlled at least in part by an information handling system disposed within the intervention tool after the still period;

performing an anchoring operation automatically controlled at least in part with the information handling system after the seek operation to anchor the intervention tool to the wellbore, wherein a second still period is between the seek operation and the anchoring operation; and performing the intervention operation automatically controlled at least in part by the information handling system with the intervention tool.

* * * * *